US006959821B2

(12) United States Patent
Huang

(10) Patent No.: US 6,959,821 B2
(45) Date of Patent: Nov. 1, 2005

(54) DISPLAY DETECTING APPARATUS FOR DISPLAY MODULE AND DETECTING ARRANGEMENT METHOD THEREFOR

(75) Inventor: Chien Chang Huang, Tainan (TW)

(73) Assignee: Hannstar Display Corp. (TW)

( * ) Notice: Subject to any disclaimer, the term of this patent is extended or adjusted under 35 U.S.C. 154(b) by 529 days.

(21) Appl. No.: 10/013,708

(22) Filed: Dec. 13, 2001

(65) Prior Publication Data

US 2002/0071068 A1 Jun. 13, 2002

(30) Foreign Application Priority Data

Dec. 13, 2000 (TW) ..... 89126850 A

(51) Int. Cl.[7] ..... A47F 7/00
(52) U.S. Cl. ..... 211/13.1
(58) Field of Search ..... 211/13.1, 49.1, 211/26, 26.2, 1.51, 94.01, 134, 183, 184, 153; 349/73

(56) References Cited

U.S. PATENT DOCUMENTS 4,586,633 A * 5/1986 Holland et al. ..... 221/257
4,892,198 A * 1/1990 Johnson ..... 211/40
5,106,047 A * 4/1992 Baer ..... 248/459
5,474,190 A * 12/1995 Won-Kim ..... 211/41.12
5,545,958 A * 8/1996 Kramer ..... 318/560
5,615,850 A * 4/1997 Cloninger ..... 248/68.1
5,839,587 A * 11/1998 Gress et al. ..... 211/59.2
6,109,457 A * 8/2000 Dahnke ..... 211/49.1

FOREIGN PATENT DOCUMENTS

JP P2002-318552 A * 10/2002 ..... G09F/9/00

* cited by examiner

*Primary Examiner*—Carl D. Friedman
*Assistant Examiner*—Jennifer E. Novosad

(57) ABSTRACT

A display detecting apparatus for detecting display modules having a display surface, includes a base, at least one flat panel generally horizontally fixed on the base; and a plurality of frames fixed on the flat panel for carrying the display modules, wherein at least two adjacent frames form a first angle less than 180 degrees.

23 Claims, 5 Drawing Sheets

DISPLAY DETECTING APPARATUS FOR DISPLAY MODULE AND DETECTING ARRANGEMENT METHOD THEREFOR

BACKGROUND OF THE INVENTION

1. Field of the Invention

This invention relates to a display detecting method for the display module, and more especially, to an aging process apparatus for use in detecting the display module having a preferred arrangement manner.

2. Description of the Related Art

In the general display manufacturing processes, for example, in the Liquid Crystal Display (LCD), and Cathode-Ray Tube Display manufacturing processes, power and signals are usually supplied into the display to detect and stabilize the practical display quality of the displays, which is usually referred as the Aging Process or Burn-in Test.

As to the LCD, the manufacturing process generally comprises: injecting the liquid crystal material between two sealed parallel glass substrates with electrodes thereon and applying polarization films onto the outer surfaces of the two glass substrates to form the LCD cell. Then, the LCD cell is assembled with driving circuits, controlling circuits and back-light elements to complete the LCD module.

The LCD modules are usually placed in the aging process apparatus to proceed the aging process after LCD modules have been completed. As shown in FIG. 1, the LCD modules are placed in the shelves 12 of the aging process apparatus 10, and each shelf 12 has a shoulder 14 to support the LCD module and a plurality of openings 16 through which the power and signal lines of the LCD module pass to be connected to the aging process apparatus 10. Therefore, the aging process apparatus 10 can supply the power source and display signals to the LCD module to proceed the aging process. The aging process apparatus 10 has other openings 18 convenient for operator's operations. The aging process apparatus 10 has five shelves 12, as shown in the drawings, and each of them can receive six LCD modules, namely, the aging process apparatus 10 can detect thirty LCD modules for each batch process. And, two aging process apparatuses are usually combined in an opposite arrangement to detect the LCD modules at both sides of the aging process apparatuses respectively. Therefore, the combination of two aging process apparatuses 10 can detect sixty LCD modules for each batch process.

However, the LCD modules are usually fabricated and tested in the cleaning room, and the aging process is the most time-consuming process during the manufacturing processes, so that the aging process apparatuses 10 occupy a very large space in the cleaning room. Therefore, regarding the fabrication of the LCD, reducing the volume of the aging process apparatus will relatively reduce the space in the cleaning room required to fabricate the LCD, and further reduce the maintaining-cost of the cleaning room and increase the throughput therefor.

In light of the above requirements, there exists a need to provide an aging process apparatus which can receive more LCD modules within the specific volume, and the operators can easily observe the LCD modules to detect the display modules.

SUMMARY OF THE INVENTION

The primary object of the present invention is to provide a detecting arrangement method for the display modules in which the aging process apparatus which can receive more LCD modules within the specific volume.

Another object of the present invention is to provide a detecting apparatus of the display modules which can receive more LCD modules within the specific volume when compared with conventional detecting apparatus.

According to the objects of the present invention, the detecting arrangement method of the display module disposes several LCD modules each having a display surface in the aging process apparatus, wherein at least two adjacent LCD modules form a first angle less than 180 degrees.

According to one aspect of the detecting arrangement method of the display modules of the present invention, the display modules are arranged in two rows, and each display surface is oriented outwardly respectively for the convenience of inspecting by operators, wherein the LCD modules of the individual row are in interlaced arrangement with one another.

According to another aspect of the detecting arrangement method of the display modules of the present invention, the display modules are disposed on a flat panel forming a second angle with respect to the flat panel, wherein the second angle is between 80–90 degrees.

According to a further aspect of the detecting arrangement method of the display modules of the present invention, the display modules are also arranged in line in the vertical direction, and the second angle decreases gradually as the height in the vertical direction increases for the convenience of inspecting by the operator.

According to another object of the present invention, the display detecting apparatus for the display module having a display surface, comprises a base, at least one flat panel generally horizontally fixed on the base; and a plurality of frames fixed on the flat panel for carrying the display modules, wherein at least two adjacent frames form a first angle less than 180 degrees.

According to the present invention, since the display modules are in interlaced arrangement forming an angle therebetween, more display modules can be arranged in the special space to increase the throughput of the display.

BRIEF DESCRIPTION OF THE DRAWINGS

Other objects, advantages, and novel features of the invention will become more apparent from the following detailed description when taken in conjunction with the accompanying drawings.

DETAILED DESCRIPTION OF THE PREFERRED EMBODIMENT

The invention is applied to the aging process and burn-in test of the display modules such as the Liquid Crystal Display (LCD) modules and Cathode-ray Tube modules, wherein the power and signals are required to supply to the display modules such that the display modules are inspected in displaying condition by operators. The following description will illustrate the invention with reference to the aging process in manufacturing the LCD modules.

Figure 2A:
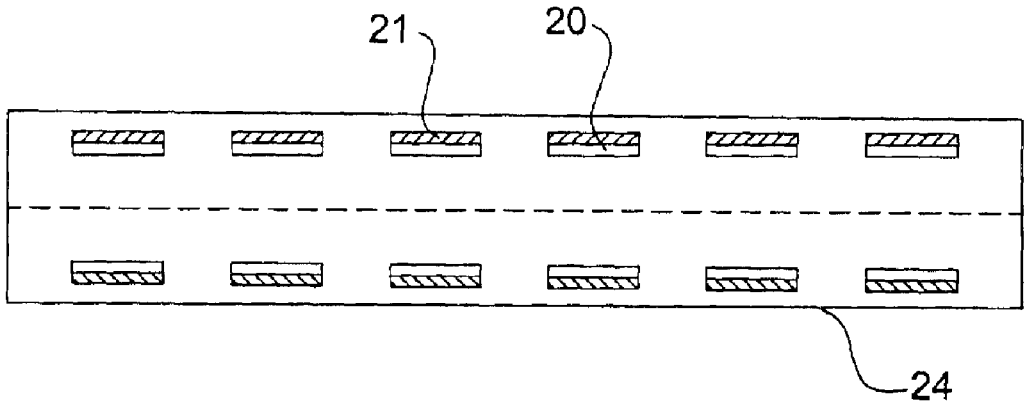
Fig.2a (Prior Art)
FIG. 2*a* is the conventional arrangement method of the display modules in the detecting process.

Referring to FIGS. 2*a,* 2*b,* and 2*c,* they show the arrangements of the aging process of the LCD display modules 20 according to conventional art and two embodiments of the present invention. As mentioned above, the aging process of the LCD display modules 20 must require supplies of power and signals for a relatively long time to detect and stabilize the display modules. Therefore, as shown in FIG. 2*a,* the display modules 20 of detecting process of the conventional art are arranged in row, and the LCD modules 20 have a display surface 21 outwardly oriented for visually detecting the LCD modules 20 by the operator. As shown in the drawings, there are twelve LCD modules 20 for proceeding the aging process in the special space.

Figure 2B:
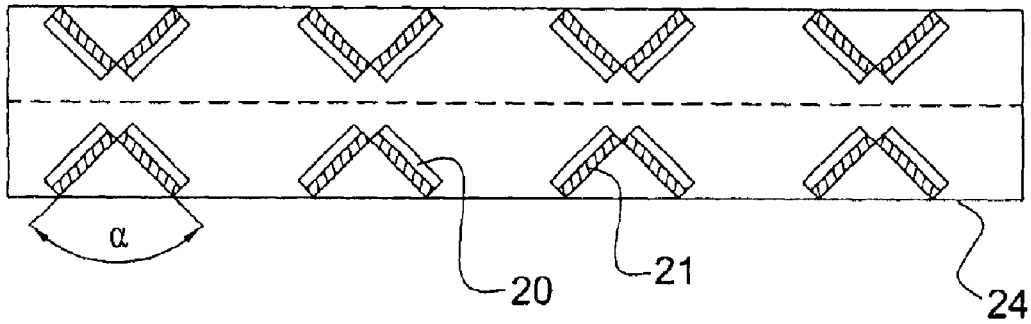
FIG. 2*b* is the arrangement method of the display modules in the detecting process according to one embodiment of the present invention.
Figure 2C:
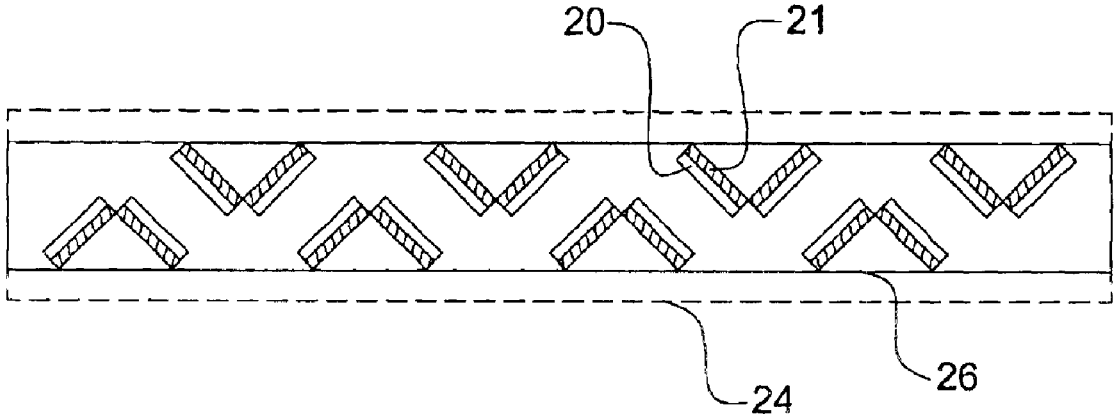
FIG. 2*c* is the arrangement method of the display module in the detecting process according to another embodiment of the present invention.

Referring to FIG. 2*b,* every two adjacent LCD modules 20 form an angle a therebetween and the display surface 21 of the LCD module 20 is outwardly oriented. Therefore, it is obvious that there are sixteen LCD modules 20 for proceeding the aging process in the same special space of the conventional art. As shown in FIG. 2*c,* the combination of the two LCD modules 20 is arranged in row at longitudinal direction and the combinations of the two LCD modules 20 are arranged to interlace with each other in lateral direction. Accordingly, the special space 24 (as shown by dotted lines in FIG. 2*c*) can further shrink in the lateral direction, namely the smaller special space 26 in the lateral direction can also contain sixteen LCD modules 20 to proceed aging process. Further, the angle a is preferably between 80–120 degrees and more preferable at 90 degrees.

Figure 3:
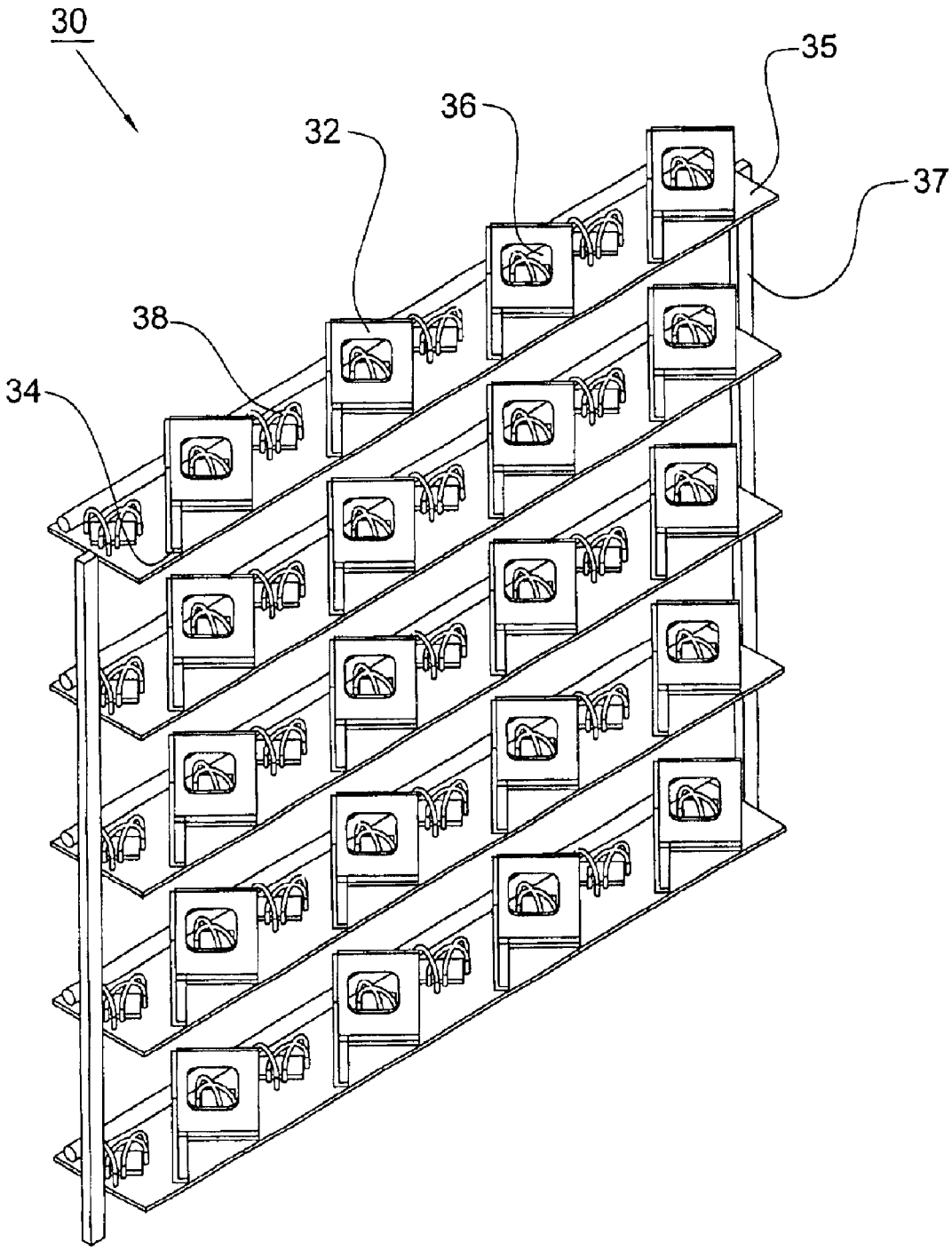
FIG. 3 is a perspective view showing the aging process apparatus of the display modules according an embodiment of the present invention.

Referring to FIG. 3, there is shown the aging process apparatus 30 of the LCD modules according to the embodiment of the present invention, wherein the aging process apparatus 30 and the conventional aging process apparatus 10 are general the same in structure, and corresponding to the arrangement method of the LCD modules as shown in FIG. 2*b.* The aging process apparatus 30 generally has a base 37, a flat panel 35 on the base 37 for supporting a plurality of frames 32. The frame 32 is used for receiving the LCD module and has a shoulder 34 to carry the LCD module. The frame 32 has an opening 36 so as to let the circuit line of the LCD module pass though to connect to the electrical device 38 of the aging process apparatus for providing the power and signals to the LCD modules to proceed the aging process.

Figure 1:
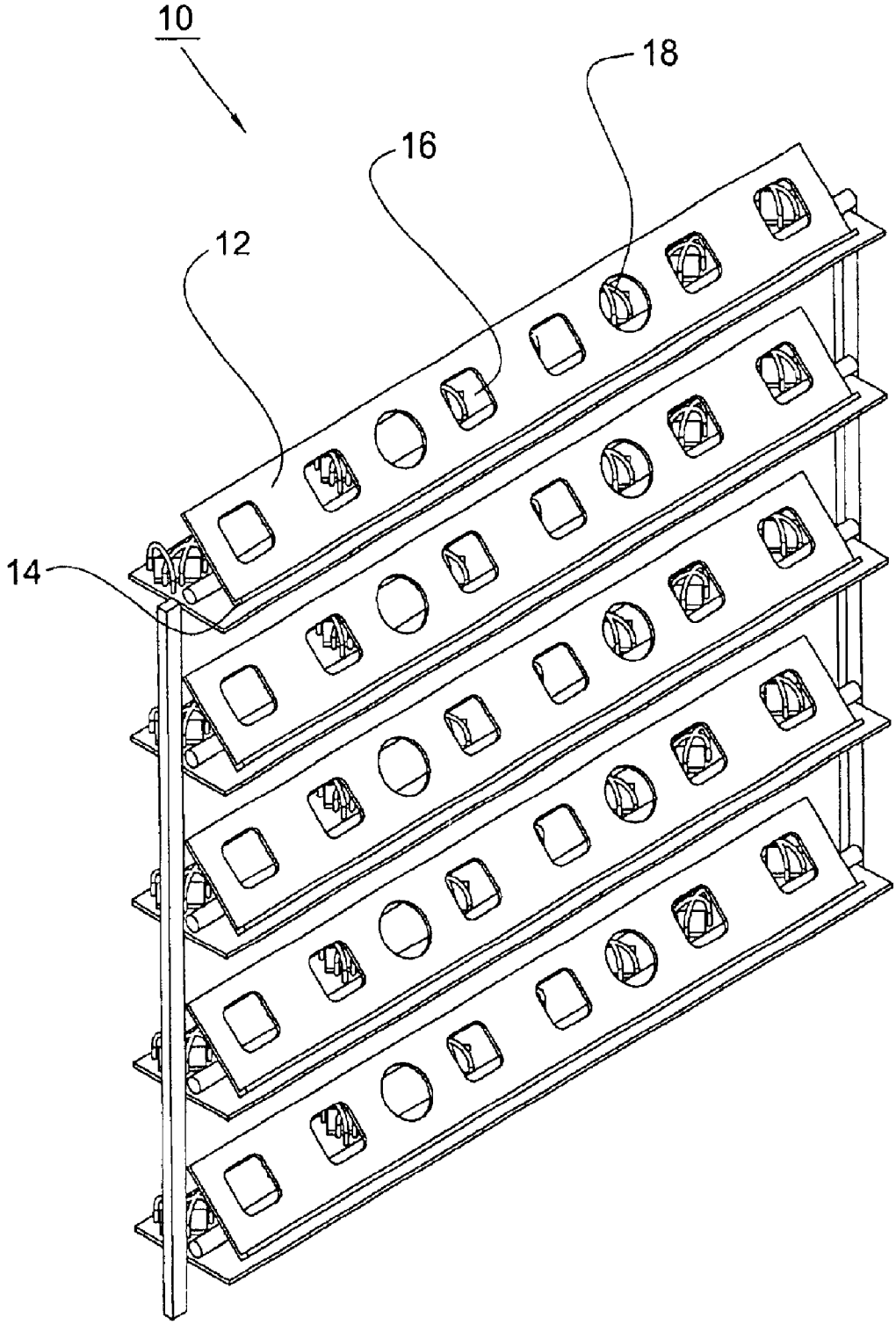
Fig.1 (Prior Art)
FIG. 1 is a perspective view showing the conventional aging process apparatus of the LCD modules.

As shown in FIGS. 1 and 3, the aging process apparatus 10 and the aging process apparatus 30 generally have the same volume, but the aging process apparatus 10 can only receive thirty LCD modules for testing for each batch process, while the aging process apparatus 30 can receive forty LCD modules for testing for each batch process.

Figure 4:
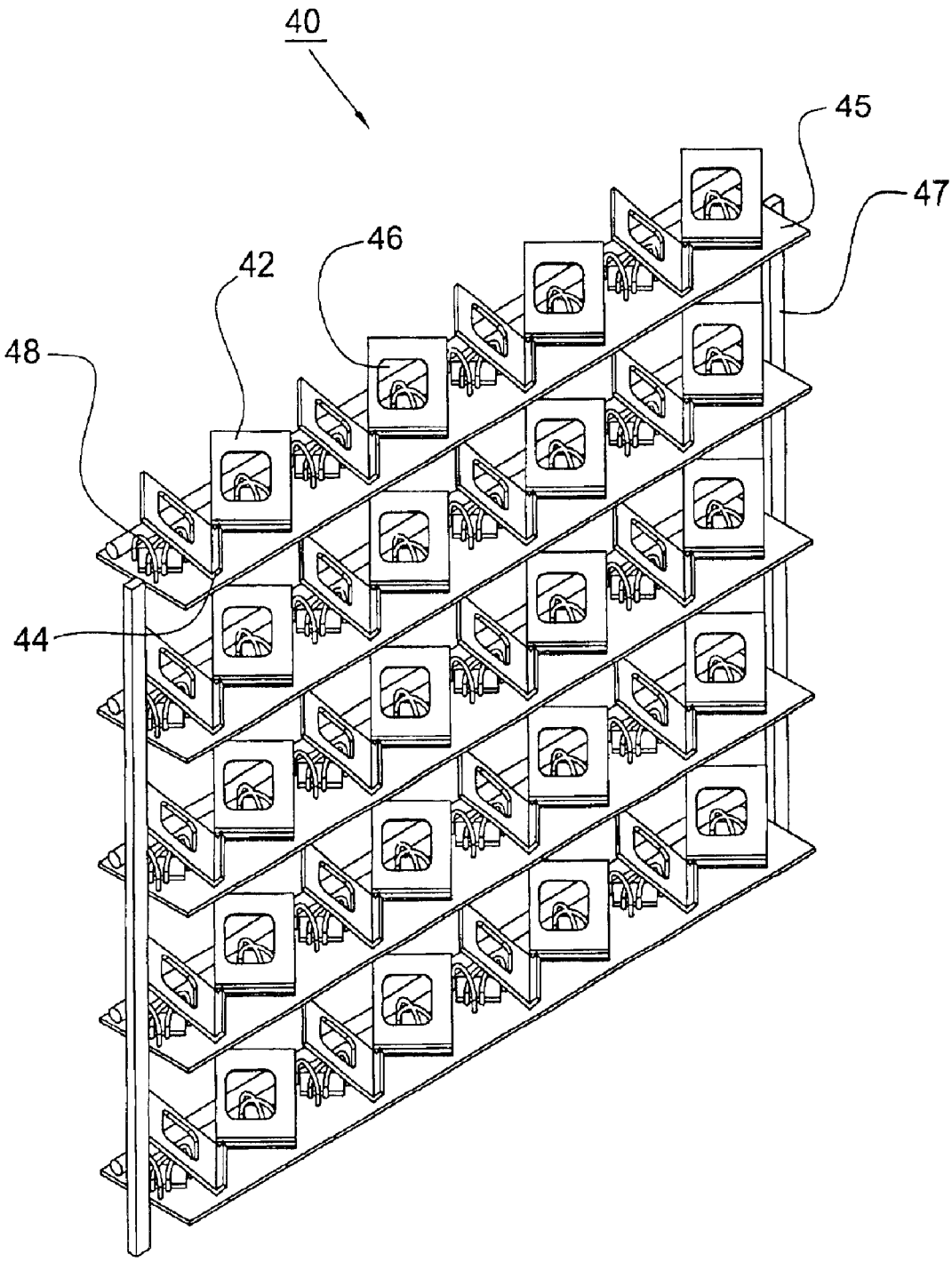
FIG. 4 is a perspective view showing the aging process apparatus of the display modules according another embodiment of the present invention.

Referring to FIG. 4, it shows the aging process apparatus 40 of the LCD modules according to another embodiment of the present invention. The aging process apparatus 40 is generally similar to the aging process apparatus 30 as shown in FIG. 3, wherein the similar elements are labeled the similar reference numerals, and the difference is that the frame 42 and the flat panel 45 of the aging process apparatus 40 form a sharp angle. Accordingly, the LCD modules are more stable placed on the frame 42, and conveniently for inspecting by operators.

Figure 5:
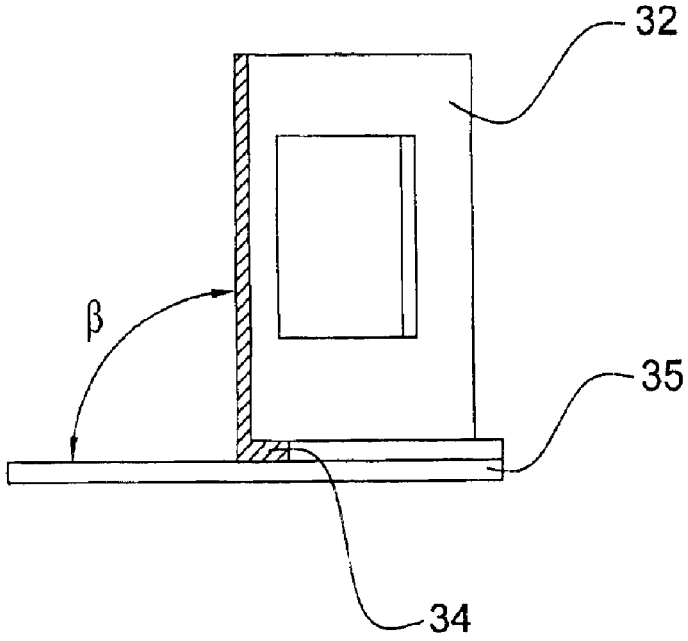
FIG. 5 is an enlarged cross-sectional view showing the frame of the aging process apparatus as shown in FIG. 3.
Figure 6:
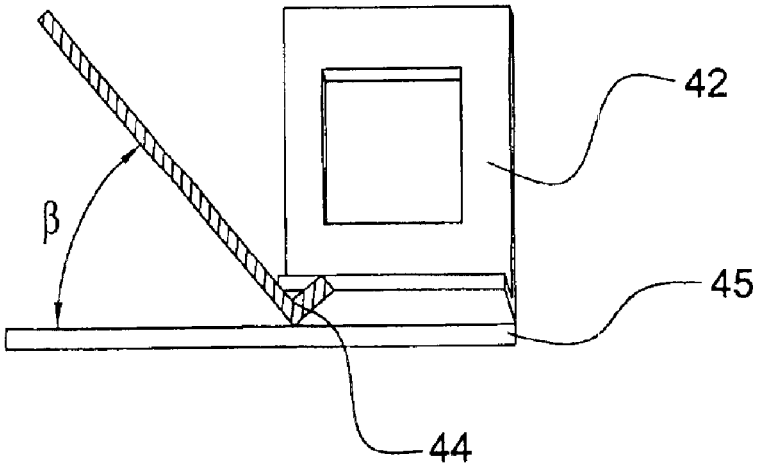
FIG. 6 is an enlarged cross-sectional view showing the frame of the aging process apparatus as shown in FIG. 4.

Referring to FIGS. 5 and 6 again, they show the relation between the frames 32 and 42 and the flat panels 35 and 45 shown in the FIGS. 3 and 4 respectively. FIG. 5 is a cross-section view of the cross plane for the frame 32 and flat panel 35 in FIG. 3, showing that the frame 32 is arranged vertically on the flat panel 35. FIG. 6 is the cross-section view of the cross plane along the frame 42 and flat panel 45 in FIG. 4, showing that the frame 42 and flat panel 45 form an angle .beta., wherein the angle .beta. is preferably between 80–90 degrees and most preferable at 85 degree. Again referring to FIGS. 4 and 6, the aging process apparatus 40 have five flat panels 45 and the angle .beta. decreases gradually with the increase of the height in vertical direction for the convenience of inspecting by the operator.

Although the invention has been explained in relation to its preferred embodiment, it is to be understood that many other possible modifications and variations can be made without departing from the spirit and scope of the invention as hereinafter claimed.

What is claimed is:

1. A display detecting method for detecting a plurality of display modules each having a display surface, the method comprising the steps of:

disposing the display surfaces of at least two adjacent display modules to form a first angle, which is less than 180 degrees; and fixing the display modules on a plane, the display surfaces of said display modules forming a second angle with respect to the plane, wherein the second angle is between 80–90 degrees.

2. The method as defined in claim 1, further comprising the step of:

disposing the plurality of display modules in two rows, wherein the display surfaces of all display modules are outwardly oriented and the display modules are interlaced with each other.

3. The method as defined in claim 1, wherein the first angle is between 80–120 degrees.

4. The method as defined in claim 1, wherein the first angle is 90 degrees.

5. The method as defined in claim 1, wherein at least one of the display modules is an LCD module.

6. The method as defined in claim 1, wherein at least one of the display modules is a Cathode-Ray Tube display module.

7. The method as defined in claim 1, wherein the second angle is 85 degrees.

8. The method as defined in claim 1, further comprising the step of:

disposing the display modules in several rows one above another, wherein the second angle decreases from a lowermost one among said rows towards an uppermost one among said rows.

9. A display detecting apparatus for detecting a plurality of display modules each having a display surface, said apparatus comprising:

a base;

at least one flat panel generally horizontally fixed on the base; and a plurality of frames fixed on the flat panel for supporting the display modules;

wherein at least two adjacent frames form a first angle less than 180 degrees; and wherein at least one of the frames is adapted to support one of the display modules on the flat panel so that the display surface of said display module forms a second angle with respect to the flat panel, wherein the second angle is between 80–90 degrees.

10. The apparatus as defined in claim 9, wherein the frames are disposed in two rows, are adapted to support the display modules with the display surfaces of all display modules outwardly oriented, and are interlaced with each other.

11. The apparatus as defined in claim 9, wherein the first angle is between 80–120 degrees.

12. The apparatus as defined in claim 9, wherein the first angle is 90 degrees.

13. The apparatus as defined in claim 9, wherein at least one of the frames is adapted to support an LCD module.

14. The apparatus as defined in claim 9, wherein at least one of the frames is adapted to support a Cathode-Ray Tube display module.

15. The apparatus as defined in claim 9, wherein the second angle is 85 degrees.

16. The apparatus as defined in claim 9, wherein the display modules are disposed in several rows one above another, wherein the second angle decreases from a lowermost one among said rows towards an uppermost one among said rows.

17. The apparatus as defined in claim 9, further comprising a circuit device for providing power and display signals to at least one of the display modules to be supported on the frames.

18. The apparatus as defined in claim 9, being an aging process apparatus.

19. The apparatus as claimed in claim 9, wherein each of said frames has an L-shaped cross section including a first flat portion and a second flat portion having a dimension smaller than that of the first flat portion; and the second flat portions of said adjacent frames together form the first angle that is less than 180 degrees.

20. The apparatus as claimed in claim 9, wherein each of said frames has an L-shaped cross section including a first flat portion and a second flat portion having a dimension smaller than that of the first flat portion; and a plane of said first flat portion forms with a plane of said flat panel a second angle less than 90 degrees.

21. The apparatus as claimed in claim 9, wherein each of said frames has an L-shaped cross section including a first portion extending upwardly from the flat panel and a second portion; and the first portion has a through opening;

said apparatus further comprising a circuit device disposed adjacent said opening.

22. The apparatus as claimed in claim 9, wherein said frames are grouped in a plurality of pairs of said adjacent frames;

said pairs are arranged in two rows along a length of said flat panel; and the pairs of one of said rows are positioned in a staggered manner with respect to the pairs of the other row.

23. A display detecting apparatus for detecting a plurality of display modules each having a display surface, said apparatus comprising:

a base;

at least one flat panel generally horizontally fixed on the base; and a plurality of frames fixed on the flat panel for supporting the display modules;

wherein at least two adjacent frames form a first angle less than 180 degrees; and said adjacent frames are not disposed in parallel.

* * * * *